US008020540B2

(12) United States Patent
Hornung

(10) Patent No.: US 8,020,540 B2
(45) Date of Patent: Sep. 20, 2011

(54) CRANKCASE VENTILATION APPARATUS OF AN INTERNAL COMBUSTION ENGINE

(75) Inventor: Dirk Hornung, Muenster (DE)

(73) Assignee: Hengst GmbH & Co. KG, Muenster (DE)

( * ) Notice: Subject to any disclaimer, the term of this patent is extended or adjusted under 35 U.S.C. 154(b) by 416 days.

(21) Appl. No.: 12/359,610

(22) Filed: Jan. 26, 2009

(65) Prior Publication Data

US 2010/0126441 A1 May 27, 2010

(30) Foreign Application Priority Data

Nov. 25, 2008 (DE) ..... 10 2008 058 962

(51) Int. Cl.
*F01M 13/04* (2006.01)

(52) U.S. Cl. ..... 123/572; 123/196 R

(58) Field of Classification Search ..... 123/572–574, 123/41.86, 196 R
See application file for complete search history.

(56) References Cited

U.S. PATENT DOCUMENTS

| | | | | |
|---|---|---|---|---|
| 5,697,350 | A * | 12/1997 | Brutsch et al. | 123/572 |
| 6,626,163 | B1 * | 9/2003 | Busen et al. | 123/572 |
| 2004/0261776 | A1 * | 12/2004 | Knaus et al. | 123/572 |
| 2006/0090737 | A1 * | 5/2006 | Pietschner | 123/572 |
| 2007/0281205 | A1 * | 12/2007 | Wagner et al. | 429/49 |
| 2007/0295315 | A1 * | 12/2007 | Guerry et al. | 123/572 |

FOREIGN PATENT DOCUMENTS

| | | | |
|---|---|---|---|
| DE | 19531695 | A1 | 3/1997 |
| DE | 19700733 | A1 | 7/1998 |
| DE | 19948163 | A1 | 4/2001 |
| DE | 20302220 | U1 | 7/2004 |

* cited by examiner

*Primary Examiner* — M. McMahon
(74) *Attorney, Agent, or Firm* — Greer, Burns & Crain, Ltd.

(57) ABSTRACT

A crankcase ventilation apparatus of an internal combustion engine of a motor vehicle, including an oil-mist separator for the separation of oil from the crankcase ventilation gas of the internal combustion engine and including an assembly for the return of lubricating oil from the oil-mist separator to an oil pan of the internal combustion engine. The oil-mist separator includes at least one preliminary separator and at least one fine separator, wherein the preliminary separator is connected to the oil pan via a first oil return flow passage allowing a continuous flow of oil there through during operation and wherein an oil collection chamber is provided downstream of an oil outlet of the fine separator, said oil collection chamber being connected to the oil pan via a second oil return flow passage which is equipped with a check valve to discontinue the flow of oil during operation. The first oil return flow passage is designed in the form of a siphon comprising a pipe section which immerses into a siphon reservoir comprising an overflow and the second oil return flow passage ends in the siphon reservoir downstream of the check valve.

20 Claims, 8 Drawing Sheets

CRANKCASE VENTILATION APPARATUS OF AN INTERNAL COMBUSTION ENGINE

BACKGROUND OF THE INVENTION

The present invention relates to a crankcase ventilation apparatus of an internal combustion engine of a motor vehicle, comprising an oil-mist separator for the separation of oil from the crankcase ventilation gas of the internal combustion engine and comprising an assembly for the return of lubricating oil from the oil-mist separator to an oil pan of the internal combustion engine, wherein the oil-mist separator comprises at least one preliminary separator and at least one fine separator, wherein the preliminary separator is connected to the oil pan via a first oil return flow passage allowing a continuous flow of oil there through during operation and wherein an oil collection chamber is provided downstream of an oil outlet of the fine separator, said oil collection chamber being connected to the oil pan via a second oil return flow passage which is equipped with a check valve to discontinue the flow of oil during operation.

DE 203 02 220 U1 shows a crankcase ventilation apparatus of the aforementioned type. Therein, the first oil return flow passage is designed in the form of an annular channel, with an oil outlet being provided adjacent to the bottom of the annular channel. The second oil return flow passage which comes from the oil collection chamber and is equipped with the check valve ends in the same oil outlet. This oil outlet is in communication with the oil pan of the associated internal combustion engine in a manner which is not described in more detail in this document.

DE 197 00 733 A1 shows a cylinder head cover which incorporates a two-stage oil-mist separator comprising a helical insert as preliminary separator and a fine separator arranged downstream of the preliminary separator. The oil separated in the preliminary separator and in the fine separator is supplied to a common single oil return flow hole in the bottommost part of the fine separator by virtue of gravity and is returned through this hole and into the engine oil circuit.

Where apparatuses according to the two documents mentioned above are concerned, crankcase ventilation gas may flow through the oil outlet or the oil return flow hole opposite to the oil flow direction provided and result in failures of the oil-mist separation. In order to prevent such failures, it is known per se to design an oil return line of an oil-mist separator with a siphon which forms a duct which is permeable to oil but tight to gas. To ensure reliable functioning of the siphon, it is, therein, essential that it contains the oil volume required for gas tightness and retains the oil volume during operation of the associated internal combustion engine.

To achieve this, DE 195 31 695 B4 proposes a crankcase ventilation of an internal combustion engine wherein an oil return line connects a pressure regulating valve to the crankcase via a check valve, wherein the oil return line comprises an oil collection chamber or siphon which is embedded in the crankcase or in a wheel house, wherein the oil collection chamber or siphon can be automatically filled with oil upon starting of the internal combustion engine, wherein the oil can be delivered by a scoop wheel or gear wheel arranged on a shaft, and wherein the housing encompassing the oil collection chamber or the siphon comprises an oil scraper nose. Although it is true that this arrangement provides for a continuous and automatic filling of the siphon, the internal combustion engine nevertheless requires special embodiments, namely the scoop wheel or gear wheel for delivery of the lubricating oil into the siphon and the oil scraper nose on the housing, which results in a high complexity and, thus, in high costs. Herein, significant inclined positions of the associated motor vehicle may, in addition, cause the oil collection chamber or siphon to be discharged, whereby the gas blocking function gets lost.

DE 199 48 163 A1 shows an apparatus for the ventilation of crankcases/cylinder heads of a combustion engine, comprising an oil separator and a return assembly for returning the separated oil into the crankcase. Therein, it is provided that the oil separator is arranged inside a line of an oil filling system of the combustion engine, the line serving to supply fresh oil into the crankcase. Therein, the return assembly, furthermore and preferably, comprises an oil-filled siphon-type section.

In this arrangement, the siphon is filled with oil while the engine is filled with lubricating oil for the first time. If required, the siphon is refilled with the oil separated in the oil separator during ongoing operation of the latter. However, this arrangement is considered to be to a disadvantage in that the free flow cross-section for filling in the fresh lubricating oil is considerably restricted by the arrangement of the oil separator and the siphon in the oil filling system, with the result that the oil can only be filled in at a low flow rate of the oil. Herein, there is the risk of fresh lubricating oil overflowing while oil is being filled in, resulting in fouling of the engine and contamination of the environment.

SUMMARY OF THE INVENTION

The present invention, therefore, aims at creating a crankcase ventilation apparatus of the aforementioned type, which obviates the drawbacks disclosed above and which reliably prevents undesired misdirected flows of crankcase ventilation gas, in particular if the oil separation efficiency is high, without special maintenance or actuation measures being necessary for this purpose, and the proper functioning of which is reliably preserved even in case of a strongly inclined position of the associated internal combustion engine and a motor vehicle equipped therewith.

This problem is solved according to the invention by means of a crankcase ventilation apparatus of the aforementioned type, which is characterized in that the first oil return flow passage is designed in the form of a siphon comprising a pipe section which immerses into a siphon reservoir comprising an overflow and that the second oil return flow passage ends in the siphon reservoir downstream of the check valve.

Advantageously, the two oil return flow passages are both running into the siphon reservoir, whereby the construction as a whole remains simple because the number of interfaces with the internal combustion engine is kept low. Furthermore, the second oil return flow passage provides for a reliable and automatic first filling of the siphon reservoir after the first start-up of the associated internal combustion engine, without further special measures having to be taken. At the beginning of the first operation run of the internal combustion engine, oil which is separated in the fine separator is collected in the oil collection chamber the check valve of which remains closed as long as the internal combustion engine is in operation. In this first operating phase, there will still be crankcase gas flowing through the first oil return flow passage because the latter is still open. After the internal combustion engine is turned off, the check valve of the oil collection chamber is opened and the oil collected therein and separated in the fine separator flows into the siphon reservoir. Thus, the siphon reservoir is provided with the oil volume required for operation and for gas tightness of the siphon in a fully automatic manner. As soon as the oil volume present in the siphon reservoir is large enough, the siphon is still permeable to oil to allow the return of the lubricating oil separated in the preliminary separator, but it is gas-tight to crankcase gas. The desired function of the siphon is, therefore, automatically ensured after a short operating time. Since further oil is continuously supplied into the siphon reservoir during ongoing further operation of the internal combustion engine, it is ensured that the siphon reservoir always remains filled to a sufficient degree or is quickly and automatically refilled after a discharge which has possibly occurred nevertheless.

In order to ensure proper functioning of the siphon even in the event of inclined positions of the associated motor vehicle, it is preferably provided that, in a horizontal position of the motor vehicle, the pipe section extends into the siphon reservoir at an angle in relation to the vertical, that a lower end of the pipe section is positioned in a bottommost region of the siphon reservoir, and that the overflow comes out of the siphon reservoir in an uppermost region of the siphon reservoir, the uppermost region being positioned in an opposite direction in relation to the end of the pipe section. In this embodiment, the distance formed between the end of the pipe section in the bottommost region of the siphon reservoir and the overflow thereof is as far as possible. As a result, an inclined position of the motor vehicle does not cause a considerable discharge of the siphon reservoir either.

In a further development with regard thereto, it is provided that with the motor vehicle being in the horizontal position, the overflow is positioned above the upper edge of the lower end of the pipe section either precisely vertically or at an angle of no more than 15°.

In particular for reasons of a compact design, it is proposed that the overflow is continued in an overflow channel extending, in essence, in a parallel direction in relation to the pipe section. What is more, a parallel extension of the overflow channel and the pipe section facilitates manufacture of these parts according to the injection-molding method because, in this case, they can be demolded in a favorable manner.

For reasons of cost-effective production, it is furthermore proposed that the first oil return flow passage comprising the pipe section and the second oil return flow passage comprising the check valve are combined to form an integral or pre-assembled structural unit. This facilitates and makes less expensive both the production and the assembly.

The siphon reservoir may be arranged at different places which depend on the space requirements in the engine compartment of an internal combustion engine and on the conditions of the internal combustion engine itself. Preferably, it is proposed that the siphon reservoir comprising the overflow is arranged in or on a cylinder head cover or a cylinder head or a cylinder bank or a crankcase of the internal combustion engine and is connected to or forms an integral part with the cylinder head cover or the cylinder head or the cylinder bank or the crankcase.

In a further embodiment, it is provided that the cylinder head cover or the cylinder head or the cylinder bank or the crankcase comprises a connecting flange for connection to the structural unit which comprises a matching companion flange. In this embodiment, the structural unit can be connected to the associated part of the internal combustion engine in a particularly fast and easy manner.

In order to prevent the occurrence of disturbing and environmentally harmful misdirected flows of gases and oil and to achieve a simple seal, the connecting flange and the companion flange, preferably, form a cylindrical plug flange connection with a radially acting seal. Herein, it is sufficient to plug the parts of the flange in each other to achieve the sealing connection. Here, it is not necessary to take special measures for generating a sealing force, which would have to be taken for an axially acting seal.

In order to prevent assembly errors and to ensure reliable functioning, the plug flange connection comprises positioning means which uniquely locate the structural unit in circumferential direction in relation to the connecting flange.

Therein, the positioning means are, preferably, formed by a threaded hole provided in the connecting flange, a screw hole which is formed to fit to the structural unit and can be brought into congruence with the threaded hole, and a screw which can be screwed into the threaded hole through the screw hole. In this manner, it is not only possible to achieve exact positioning but also that the structural unit is reliably secured to the associated connecting flange. If required, it is also possible to provide two or more threaded holes, screw holes and screws.

BRIEF DESCRIPTION OF THE DRAWINGS

An exemplary embodiment of the invention will be illustrated below by means of a drawing. In the drawing.

DETAILED DESCRIPTION OF THE PREFERRED EMBODIMENTS

Figure 1:
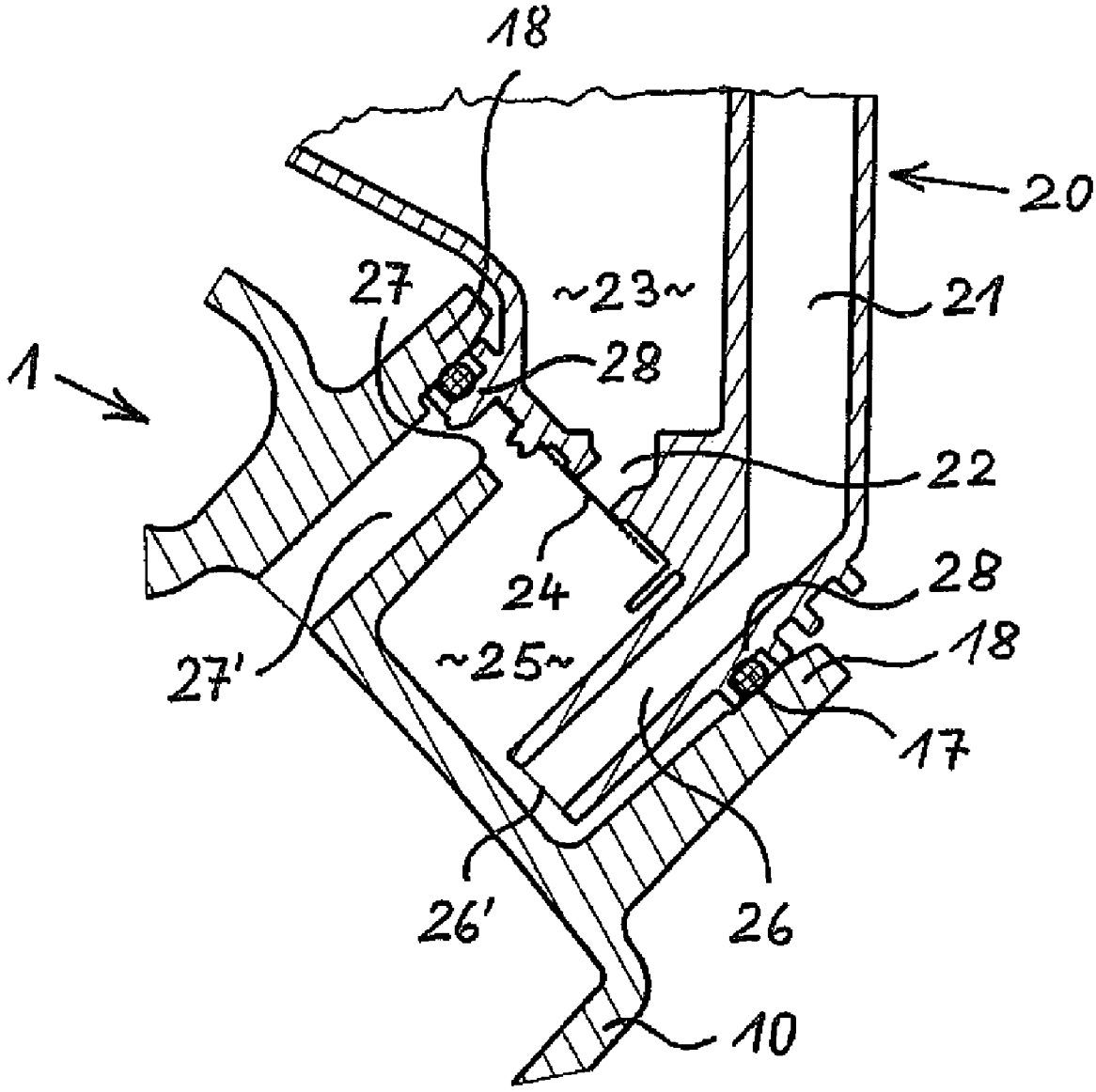
FIG. 1 is a vertical section of an oil return assembly forming part of a crankcase ventilation apparatus, in a state prior to a first startup of the associated internal combustion engine.

FIG. 1 is a vertical section of an oil return assembly 1 for the return of lubricating oil that has been separated in an oil-mist separator into the oil circuit of an internal combustion engine. Herein, the oil return assembly 1 is, on the one hand, part of a cylinder head cover 10 which is visible in part and, on the other hand, part of a structural unit 20 which forms a lower part of an oil-mist separator not shown here.

A first oil return flow passage 21 coming from a preliminary separator of the oil-mist separator is provided in the structural unit 20, said preliminary separator separating coarse-particle oil from a crankcase ventilation gas flow. A second oil return flow passage 22 serves to return further lubricating oil to the oil circuit of the internal combustion engine, the lubricating oil being separated in a fine separator of the oil-mist separator. The two oil return flow passages 21 and 22 end in a siphon reservoir 25 which is formed in the cylinder head cover 10. The structural unit 20 comprising the two oil return flow passages 21 and 22 is inserted in the cylinder head cover 10 by means of a cylindrical plug flange connection, with an intermediate layer of a radially acting seal 17.

Inside the siphon reservoir 25, the first oil return flow passage 21 passes into a pipe section 26 which extends at an angle of approximately 45° in relation to the vertical and the end 26' of which is positioned in the bottommost region of the siphon reservoir 25.

The second oil return flow passage 22 extends from an oil collection chamber 23 arranged thereabove and through a check valve 24 and also ends in the siphon reservoir 25. Herein, the check valve 24 is a meander valve which is closed during ongoing operation of an associated internal combustion engine and opens during standstill of the associated internal combustion engine, each in relation to the pressures then prevailing on the two sides of the valve. It is also possible to insert a reed valve or a valve with a valve adjustment shim in the stead of the meander valve.

An overflow 27 which is positioned in the uppermost region of the siphon reservoir 25 extends from the siphon reservoir 25 into an overflow channel 27' which extends downwards into the interior region of the cylinder head cover 10 at an angle and approximately in parallel in relation to the pipe section 26. In this way, lubricating oil coming from the overflow channel 27' can be resupplied to the lubricating oil circuit of the associated internal combustion engine.

In order to form the above-mentioned flange connection, the cylinder head cover 10 is provided with a connecting flange 18 which is designed in the form of a ring and into which the structural unit 20 can be inserted with a companion flange 28 formed in matching manner. The structural unit 20 is located in the connecting flange 18 in a detachable manner by means of connecting means which are not shown here.

Figure 2:
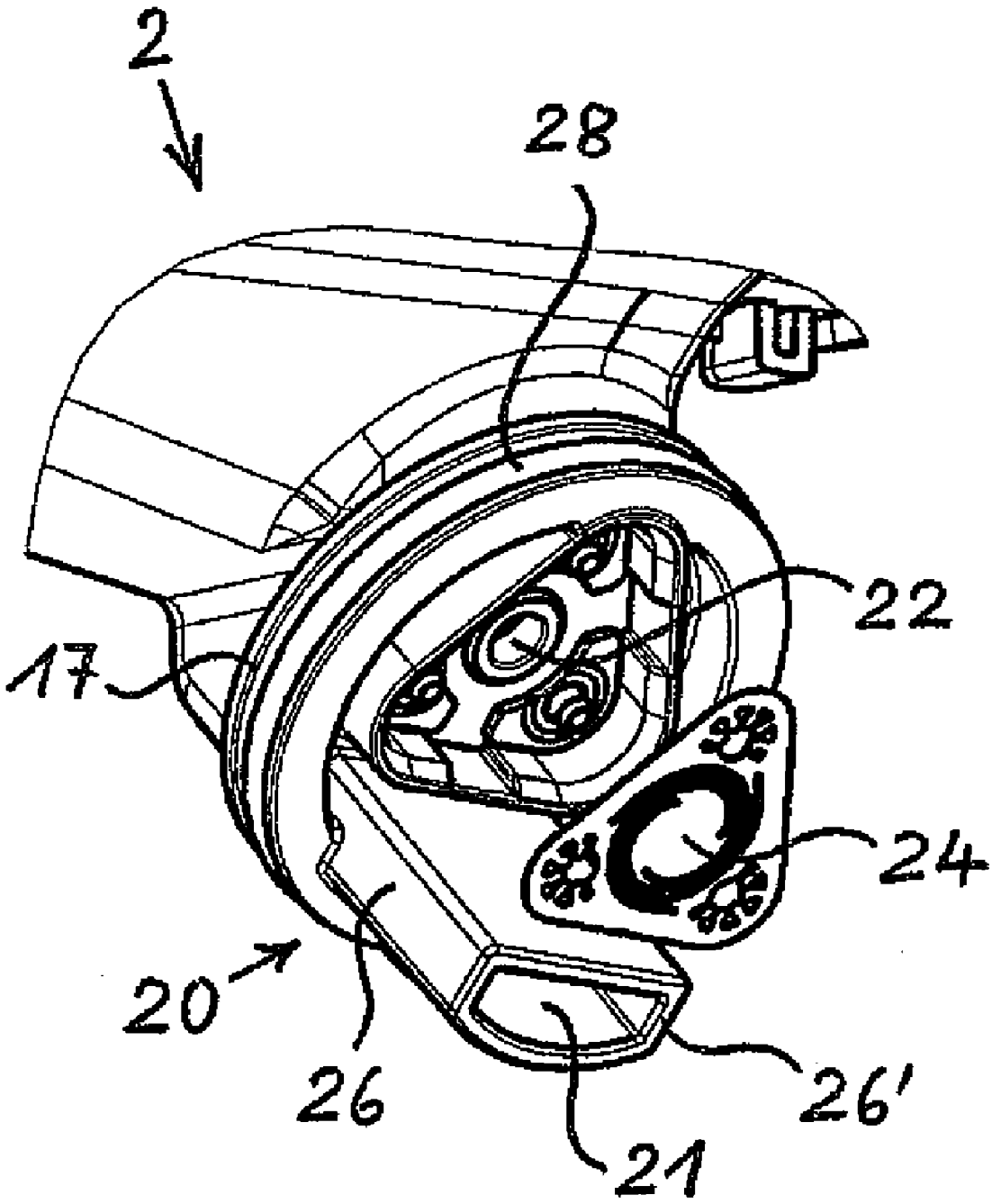
FIG. 2 is a partial view of an oil-mist separator comprising the parts of the oil return assembly present thereon, in perspective.

FIG. 2 is a view of a detail of the oil-mist separator 2 comprising the companion flange 28 and the oil return flow passages 21 and 22 extending through the structural unit 20. The check valve 24 which is positioned in the oil return flow passage 22 and which is, in the illustrated instance, designed in the form of a meander valve is drawn detached here in order to make the second oil return flow passage 22 visible which is positioned behind the check valve 24. The pipe section 26 through which the first oil return flow passage 21 extends is visible at the bottom of FIG. 2. Therein, the lower end 26' of the pipe section 26 faces the viewer.

The radially acting seal 17 is attached on the outside of the companion flange 28, the radially acting seal 17 serving to seal the flange connection, as has already been illustrated in FIG. 1.

Figure 3:
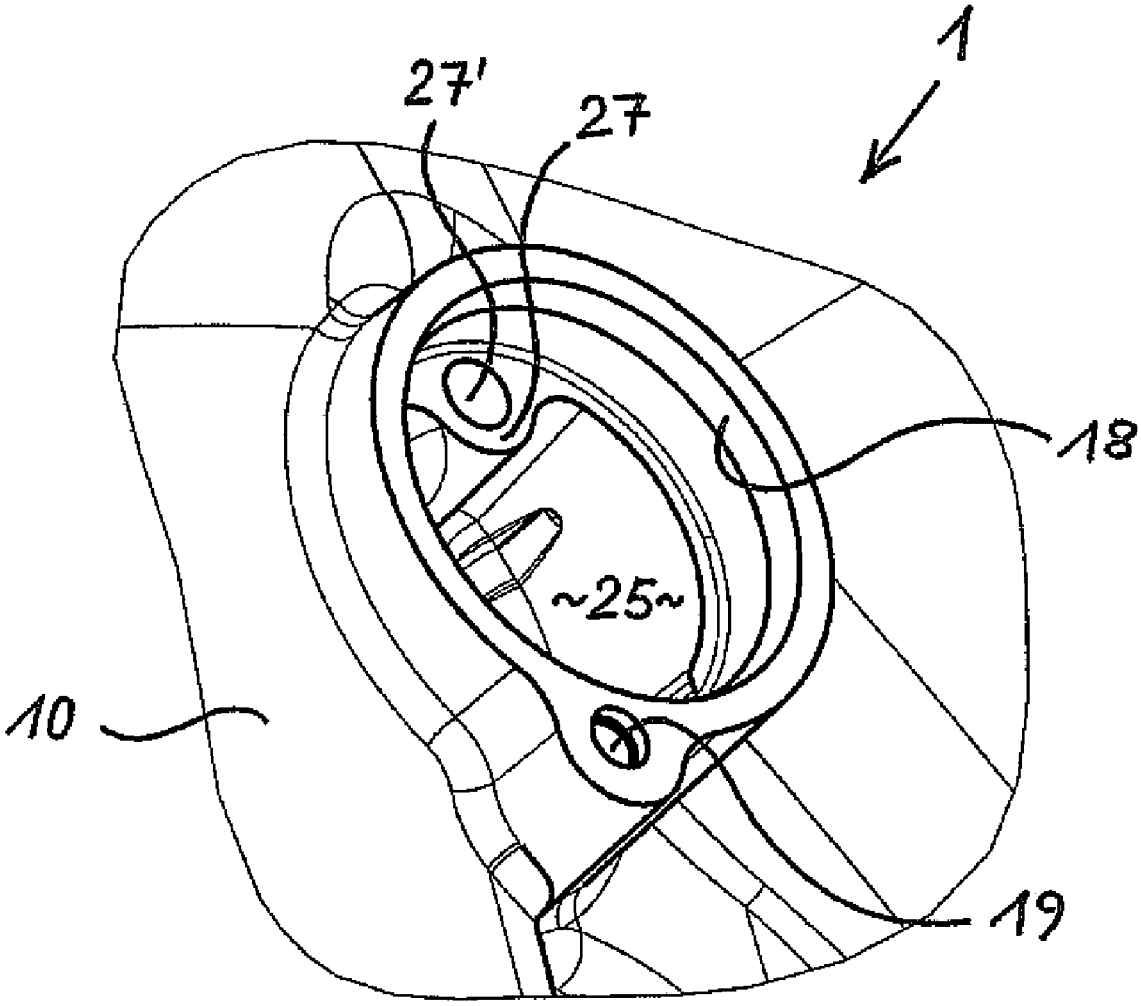
FIG. 3 is a partial view of a cylinder head cover comprising the parts of the oil return assembly present thereon, also in perspective.

FIG. 3 is a perspective view of a detail of the cylinder head cover 10 comprising the connecting flange 18 arranged therein. The structural unit 20, along with its companion flange 28, can be inserted into this annular connecting flange 18.

In FIG. 3, the viewer can see into the siphon reservoir 25 inside the connecting flange 18. The overflow 27 and the overflow channel 27' adjacent thereto are visible at the top of the siphon reservoir 25.

In order to position the structural unit 20 in circumferential direction in relation to the connecting flange 18 and in order to locate the structural unit 20 after it has been connected to the connecting flange 18, use is made of a threaded hole 19 which, in the illustrated instance, is formed to fit in the lower region of the connecting flange 18. If the oil-mist separator 2 is positioned correctly with the associated structural unit 20, a screw hole formed to fit not shown in the drawings comes into congruent position with the threaded hole 19. In this position, a mounting screw can then be screwed through the screw hole in the structural unit 20 and into the threaded hole 19.

Figure 4:
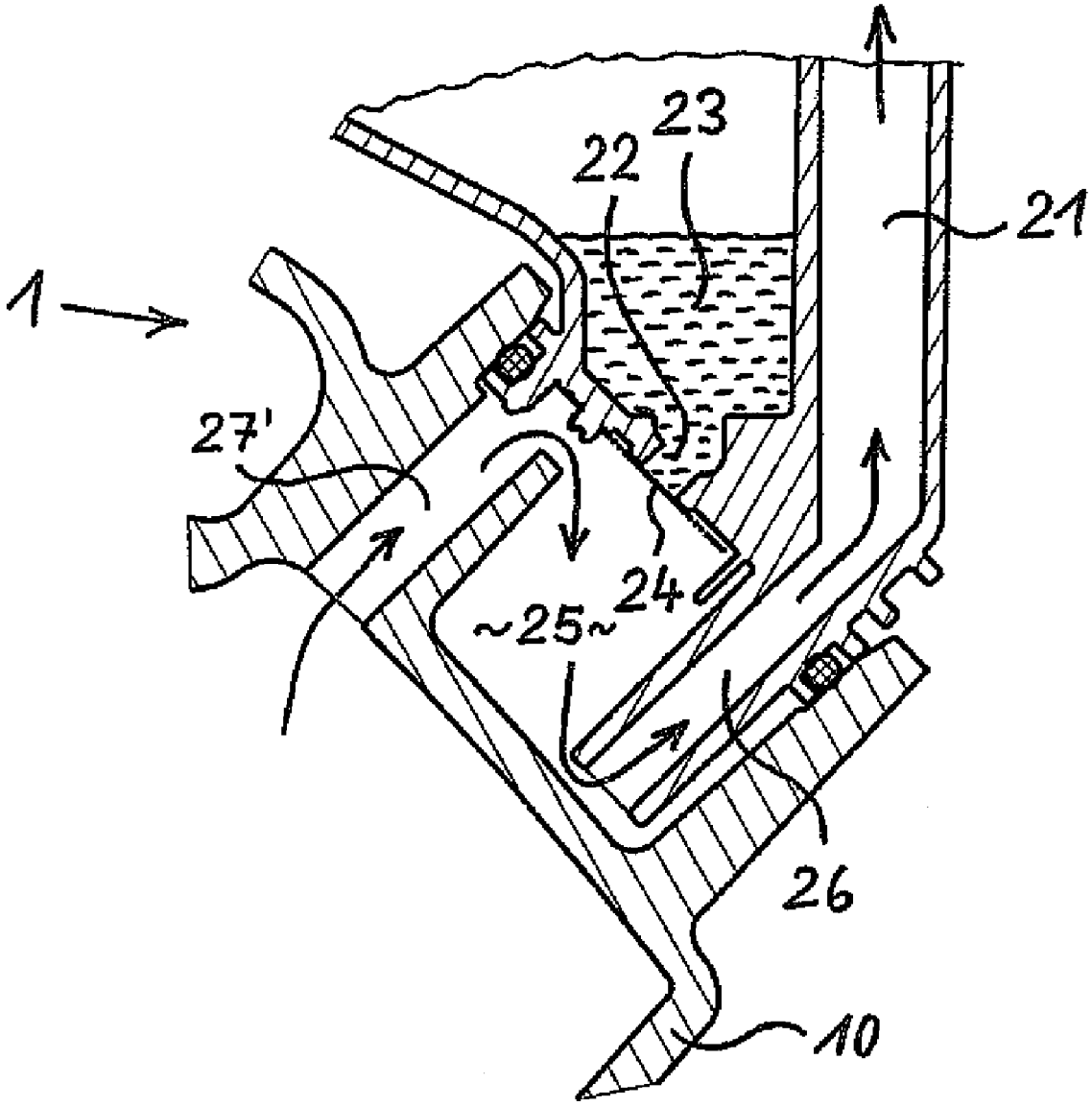
FIG. 4 is a view of the oil return assembly of FIG. 1, now in a state during the first startup of the internal combustion engine.

FIG. 4 shows the oil return assembly 1 shortly after a first startup of the associated internal combustion engine, in the same view as in FIG. 1. At this point, the fine separator which forms part of the oil-mist separator already separates oil mist from the crankcase ventilation gas, and the separated oil is collected in the oil collection chamber 23 where it remains for the time being because, owing to differences in pressure with the internal combustion engine running, the check valve 24 closes the oil collection chamber 23 and the second oil return flow passage 22 outcoming therefrom.

In the illustrated instance, crankcase gas flows, at the same time, out of the interior region of the cylinder head cover 10 through the overflow channel 27, the siphon reservoir 25, the pipe section 26 and the first oil return flow passage 21 and to the preliminary separator in the direction of the arrows drawn in FIG. 4, which is actually undesired but which is accepted for a limited time on first startup.

Figure 5:
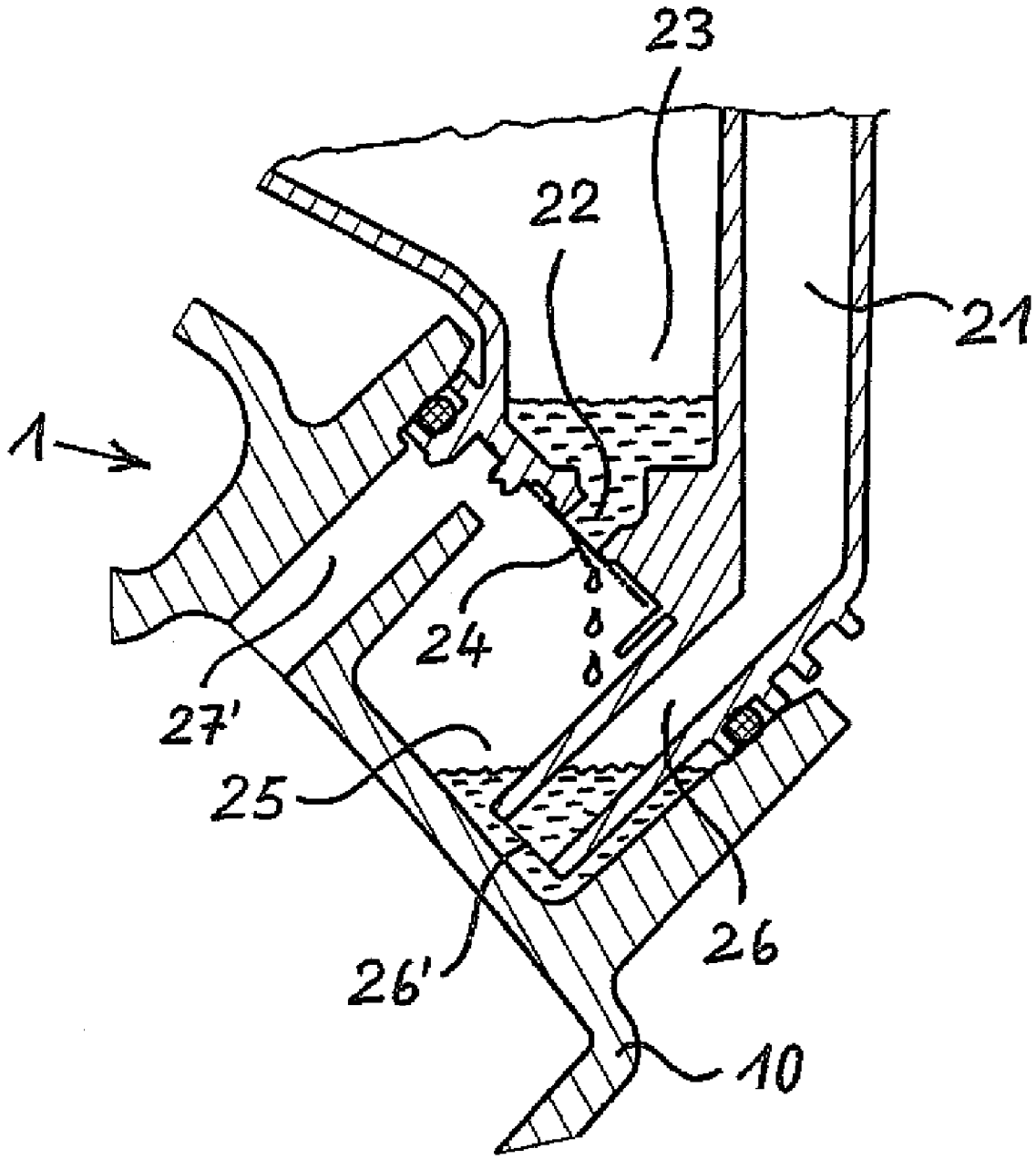
FIG. 5 is a view of the oil return assembly of FIG. 1, in a state subsequent to the first startup of the internal combustion engine.

FIG. 5 shows the oil return assembly 1 in a state immediately after completion of the first operational use of the associated internal combustion engine, in the same view as in FIG. 4. Once the internal combustion engine is turned off, the check valve 24 opens and the oil collected in the oil collection chamber 23 flows through the second oil return flow passage 22 and into the siphon reservoir 25. This results in a rising oil level in the siphon reservoir 25, wherein said oil level, after having exceeded a specific level height, establishes a gas-tight closure of the first end 26' of the pipe section 26 of the first oil return flow passage 21. In this manner, the siphon reservoir 25 automatically receives the oil filling required for the siphon function without particular maintenance measures and, in particular, without any modifications to moving parts of the internal combustion engine either.

Figure 6:
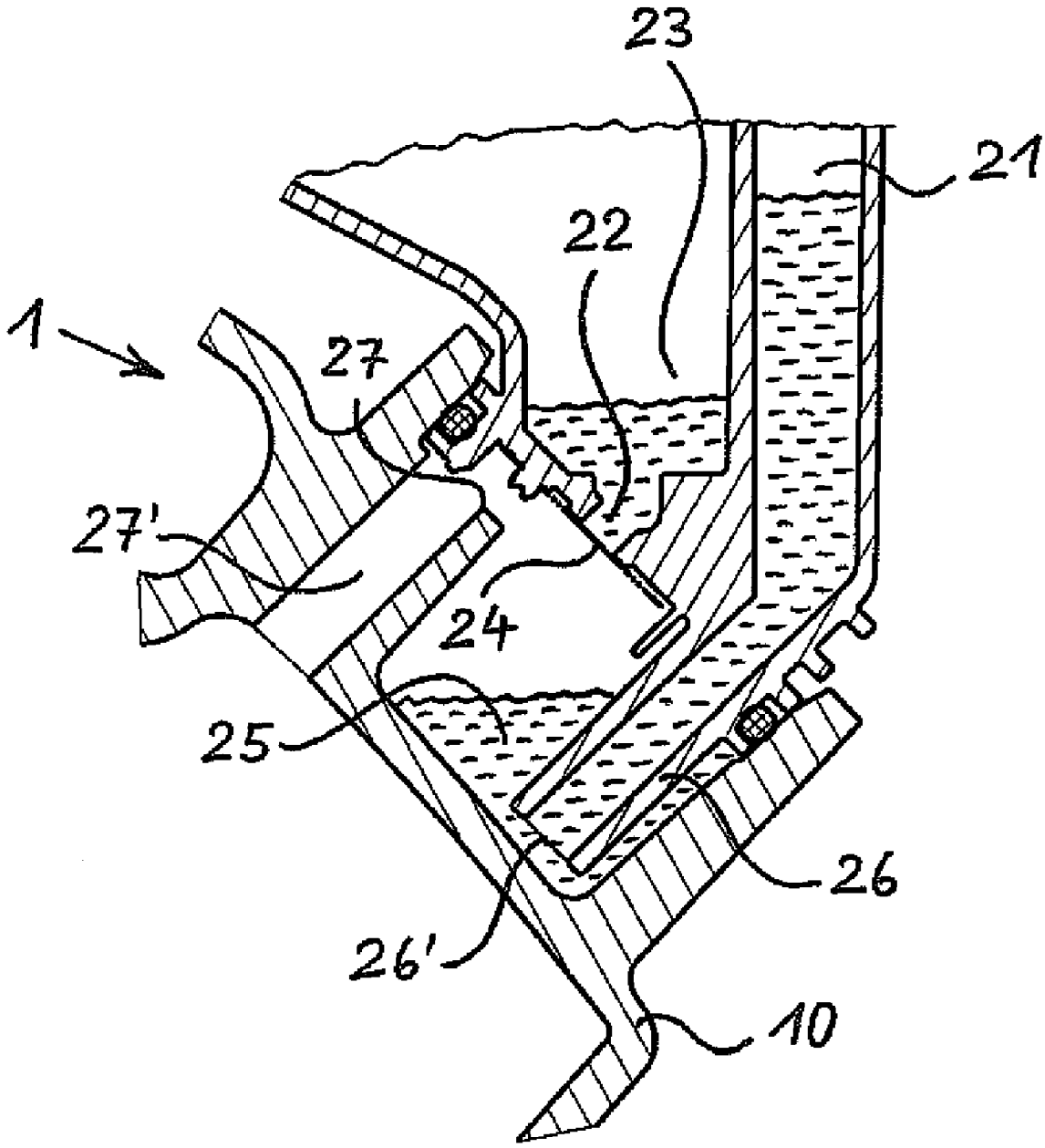
FIG. 6 is a view of the oil return assembly of FIG. 1, in a state during a later ongoing operation of the internal combustion engine.

FIG. 6 shows the oil return assembly 1 during a later operation of the associated internal combustion engine, again in the same view as in FIGS. 4 and 5. The siphon reservoir 25 is partially filled with oil, whereby the lower end 26' of the pipe section 26 is closed against penetrating gas. Lubricating oil flowing in through the first oil return flow passage 21 flows through the pipe section 26 and the lower end 26' of this pipe section 26 and into the siphon reservoir 25. Even if there is a difference in pressure between the higher pressure in the interior region of the cylinder head cover 10 and the lower pressure in the upper oil-free region of the first oil return flow passage 21, as it is present in the state of the oil return assembly 1 shown in FIG. 6, the closure of the siphon against penetrating gas remains preserved because the oil present in the siphon reservoir 25 suffices to preserve the desired gas-tight closure even if part of the oil is displaced from the siphon reservoir 25 into the pipe section 26 and the first oil return flow passage 21.

Figure 7:
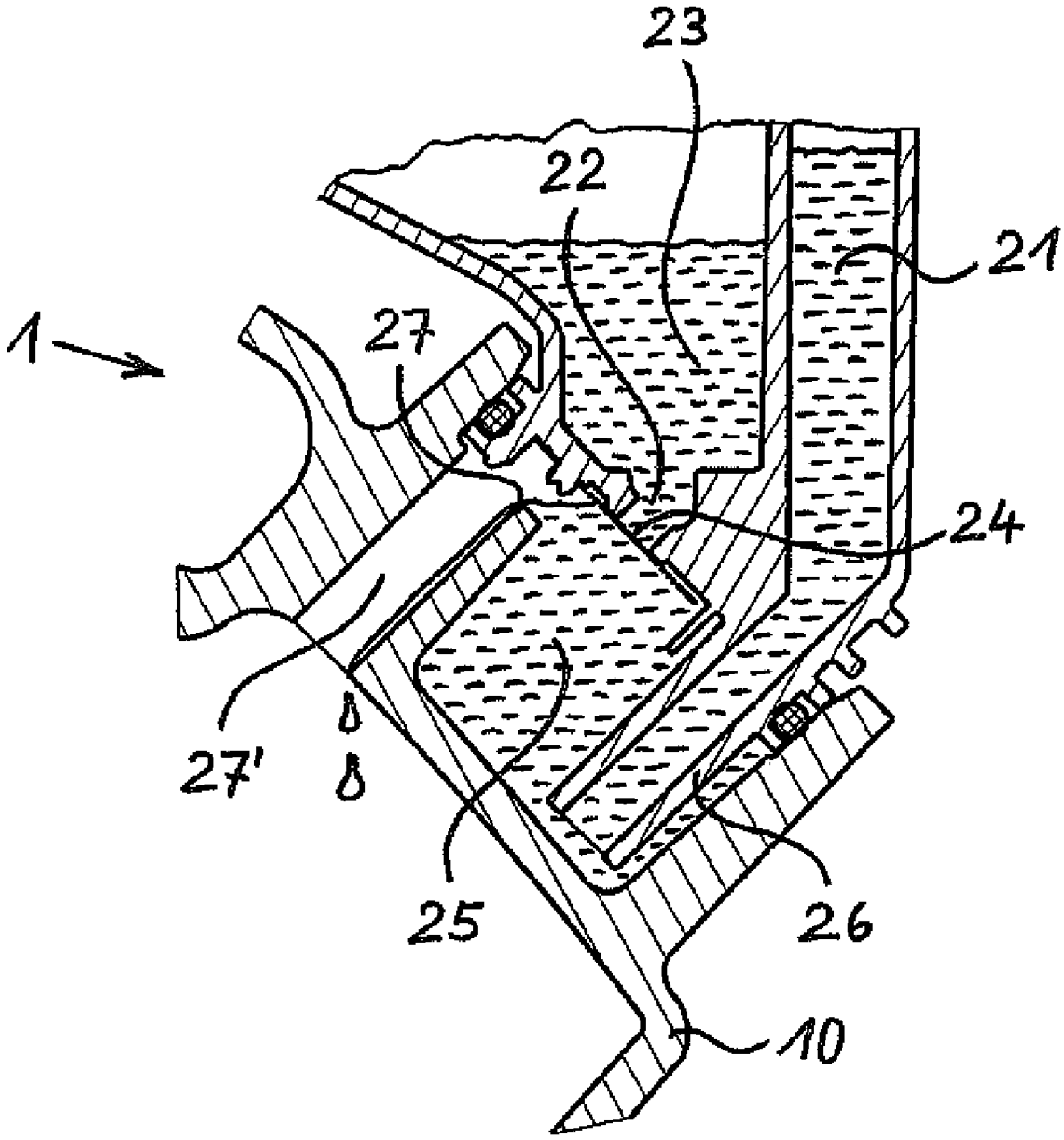
FIG. 7 is a view of the oil return assembly of FIG. 1, in a state during an even later ongoing operation of the internal combustion engine.

The state of the oil return assembly 1 shown in FIG. 7 results during continuing operation of the internal combustion engine. In this state, the siphon reservoir 25 is completely filled with oil and further lubricating oil continuously flowing in through the first oil return flow passage 21 is discharged via the overflow 27, through the overflow channel 27' and into the interior region of the cylinder head cover 10 and is, thus, resupplied to the lubricating oil circuit of the internal combustion engine.

If the internal combustion engine is then turned off, the check valve 24 opens and the oil flows from the oil collection chamber 23 into the siphon reservoir 25 and from there via the overflow 27, through the overflow channel 27' and into the interior region of the cylinder head cover 10 as well, with the result that this oil is also resupplied to the lubricating oil circuit of the internal combustion engine. Therein, the oil flow is continued until the oil level has exactly reached the level of the overflow 27, both in the first oil return flow passage 21 and in the second oil return flow passage 22. It is now no longer possible that further oil is discharged from the siphon reservoir 25 whereby the volume of oil remaining in the siphon reservoir 25 is always that required for the siphon function. Appropriately, the volume of the oil collection chamber 23 is selected such that it can reliably receive the oil volume developing if operation of the internal combustion engine is not interrupted for the maximum duration, i.e. between two refueling stops.

Figure 8:
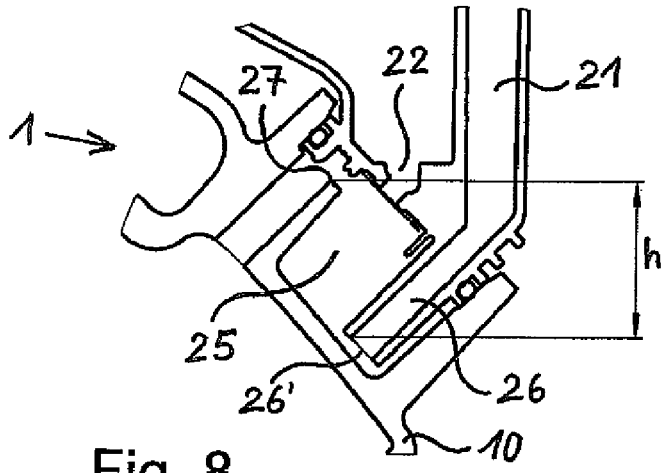
FIG. 8 is a simplified vertical sectional view of the oil return assembly with an associated motor vehicle being aligned horizontally.

FIG. 8 is a vertical sectional view of the oil return assembly 1 in a simplified presentation. Therein, a motor vehicle which is equipped with the oil return assembly 1 is aligned horizontally in FIG. 8. Therein, the first oil return flow passage 21 initially extends in a vertical direction from top to bottom and passes into the obliquely extending pipe section 26 in the siphon reservoir. Herein, there is a height difference h between an upper edge of the open end 26' of the pipe section 26 of the first oil return flow passage 21 on the one hand and the overflow 27 of the siphon reservoir 25 on the other hand, said height difference h representing the height of the effective oil level for achieving the siphon effect.

Figure 9:
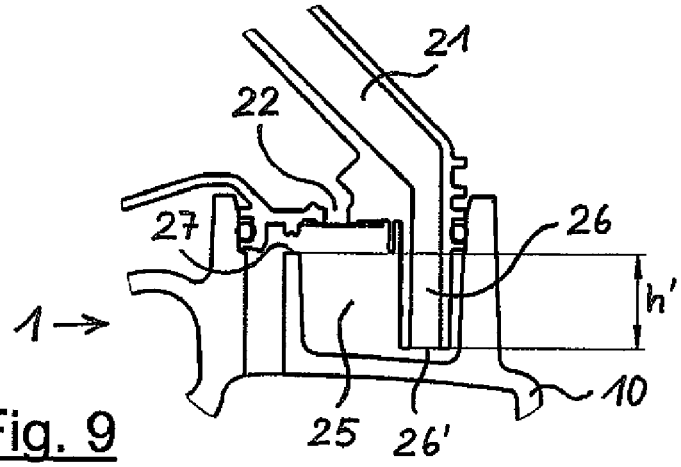
FIG. 9 is a view of the oil return assembly of FIG. 8, now with the motor vehicle being in a position which is inclined by 45° to the left in relation to FIG. 8.

If the motor vehicle is inclined out of its horizontal position shown in FIG. 8 and to the left by approximately 45°, the oil return assembly 1 will take the position shown in FIG. 9. Due to the inclination made, the first oil return flow passage 21 now extends at an angle from top to bottom and passes into the pipe section 26 which is now extending in a vertical direction. Despite the inclination by approximately 45°, the height difference h' remaining between the open end 26' of the pipe section 26 on the one hand and the overflow 27 of the siphon reservoir 25 is sufficient to preserve an oil level which suffices to achieve the siphon function.

Figure 10:
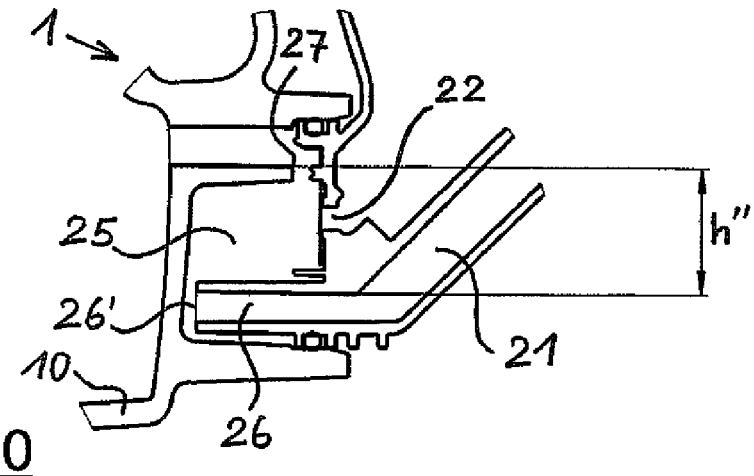
FIG. 10 is a view of the oil return assembly of FIG. 8, with the motor vehicle being in a position which is inclined by 45° to the right in relation thereto.

FIG. 10 shows the oil return assembly after an inclination from the state shown in FIG. 8 by approximately 45° to the right. In this oppositely inclined state, the first oil return flow passage 21 again extends at an angle from top to bottom and passes into the pipe section 26 which is, in essence, then extending in a horizontal direction. In this state, a height difference h" remains between an upper edge of the open end 26' of the pipe section 26 on the one hand and the overflow 27 of the siphon reservoir 25 on the other hand, said height difference h" again ensuring an oil level which is high enough to achieve the desired siphon function.

Hence, FIGS. 8, 9 and 10 illustrate that the oil return assembly 1 maintains its function even in extremely inclined positions of the associated motor vehicle because a return of the oil separated in the oil separator is always ensured and because an oil level which is high enough to ensure the siphon function is always provided for and an undesired discharge of the siphon reservoir 25 is prevented even in exceptionally inclined positions.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

LIST OF REFERENCE SYMBOLS

| Reference symbol | Description |
|---|---|
| 1 | Oil return assembly |
| 10 | Cylinder head cover |
| 17 | Radially acting seal |
| 18 | Connecting flange |
| 19 | Threaded hole |
| 2 | Oil-mist separator |
| 20 | Structural unit |
| 21 | First oil return flow passage |
| 22 | Second oil return flow passage |
| 23 | Oil collection chamber |
| 24 | Check valve |
| 25 | Siphon reservoir |
| 26 | Pipe section |
| 26' | End of 26 |
| 27 | Overflow |
| 27' | Overflow channel |
| 28 | Companion flange |

The invention claimed is:

1. A crankcase ventilation apparatus of an internal combustion engine of a motor vehicle, comprising an oil-mist separator for the separation of oil from the crankcase ventilation gas of the internal combustion engine and comprising an assembly for the return of lubricating oil from the oil-mist separator to an oil pan of the internal combustion engine, wherein the oil-mist separator comprises at least one preliminary separator and at least one fine separator, wherein the preliminary separator is connected to the oil pan via a first oil return flow passage allowing a continuous flow of oil therethrough during operation and wherein an oil collection chamber is provided downstream of an oil outlet of the fine separator, said oil collection chamber being connected to the oil pan via a second oil return flow passage which is equipped with a check valve to discontinue the flow of oil during operation, comprising:

the first oil return flow passage is designed in the form of a siphon comprising a pipe section which immerses into a siphon reservoir comprising an overflow, and the second oil return flow passage ends in the siphon reservoir downstream of the check valve.

2. The crankcase ventilation apparatus according to claim 1, wherein in a horizontal position of the motor vehicle, the pipe section extends into the siphon reservoir at an angle in relation to the vertical, such that a lower end of the pipe section is positioned in a bottommost region of the siphon reservoir, and such that the overflow comes out of the siphon reservoir in an uppermost region of the siphon reservoir, said uppermost region being positioned in opposite direction in relation to the end of the pipe section.

3. The crankcase ventilation apparatus according to claim 2, wherein with the motor vehicle being in the horizontal position, the overflow is positioned above an upper edge of the lower end of the pipe section either precisely vertically or at an angle of no more than 15 degrees from vertical.

4. The crankcase ventilation apparatus according to claim 2, wherein the overflow is continued in an overflow channel extending, in essence, in a parallel direction in relation to the pipe section.

5. The crankcase ventilation apparatus according to claim 1, wherein the first oil return flow passage comprising the pipe section and the second oil return flow passage comprising the check valve are combined to form an integral or pre-assembled structural unit.

6. The crankcase ventilation apparatus according to claim 1, wherein the siphon reservoir comprising the overflow is arranged in or on a cylinder head cover or a cylinder head or a cylinder bank or a crankcase of the internal combustion engine and is connected to or forms an integral part with the cylinder head cover or the cylinder head or the cylinder bank or the crankcase or is formed integrally.

7. The crankcase ventilation apparatus according to claim 5, wherein the cylinder head cover or the cylinder head or the cylinder bank or the crankcase comprises a connecting flange for connection to the structural unit which comprises a matching companion flange.

8. The crankcase ventilation apparatus according to claim 7, wherein the connecting flange and the companion flange form a cylindrical plug flange connection with a radially acting seal.

9. The crankcase ventilation apparatus according to claim 8, wherein the plug flange connection comprises positioning means which uniquely locate the structural unit in circumferential direction in relation to the connecting flange.

10. The crankcase ventilation apparatus according to claim 9, wherein the positioning means are formed by a threaded hole provided in the connecting flange, a screw hole which is formed to fit to the structural unit and can be brought into congruence with the threaded hole, and a screw which can be screwed into the threaded hole through the screw hole.

11. A crankcase ventilation apparatus of an internal combustion engine of a motor vehicle, comprising:

an oil-mist separator arranged to separate oil from the crankcase ventilation gas of the internal combustion engine;

an assembly arranged to return lubricating oil from the oil-mist separator to an oil pan of the internal combustion engine;

the oil-mist separator comprising at least one preliminary separator and at least one fine separator;

the preliminary separator being connected to the oil pan via a first oil return flow passage allowing a continuous flow of oil therethrough during operation;

an oil collection chamber being provided downstream of an oil outlet of the fine separator;

said oil collection chamber being connected to the oil pan via a second oil return flow passage which is equipped with a check valve to discontinue the flow of oil during operation;

the first oil return flow passage being formed as a siphon comprising a pipe section which immerses into a siphon reservoir comprising an overflow; and the second oil return flow passage ending in the siphon reservoir downstream of the check valve.

12. The crankcase ventilation apparatus according to claim 11, wherein in a horizontal position of the motor vehicle, the pipe section extends into the siphon reservoir at an angle in relation to the vertical, such that a lower end of the pipe section is positioned in a bottommost region of the siphon reservoir, and such that the overflow is positioned in an uppermost region of the siphon reservoir, said uppermost region being positioned in opposite direction in relation to the end of the pipe section.

13. The crankcase ventilation apparatus according to claim 12, wherein in a horizontal position of the motor vehicle, the overflow is positioned above an upper edge of the lower end of the pipe section within an angle of no more than 15 degrees from vertical.

14. The crankcase ventilation apparatus according to claim 12, wherein the overflow is continued in an overflow channel which extends in a direction parallel to the pipe section.

15. The crankcase ventilation apparatus according to claim 11, wherein the first oil return flow passage comprising the pipe section and the second oil return flow passage comprising the check valve are combined to form a one piece unit.

16. The crankcase ventilation apparatus according to claim 11, wherein the siphon reservoir comprising the overflow is arranged in or on at least one of a cylinder head cover, a cylinder head, a cylinder bank and a crankcase of the internal combustion engine and is connected to or forms an integral part with said one of the cylinder head cover, the cylinder head, the cylinder bank and the crankcase.

17. The crankcase ventilation apparatus according to claim 15, wherein said at least one of the cylinder head cover, the cylinder head, the cylinder bank and the crankcase comprises a connecting flange for connection to the structural unit which comprises a matching companion flange.

18. The crankcase ventilation apparatus according to claim 17, wherein the connecting flange and the companion flange form a cylindrical plug flange connection with a radially acting seal.

19. The crankcase ventilation apparatus according to claim 18, wherein the plug flange connection comprises positioning means which uniquely locate the structural unit in a circumferential direction in relation to the connecting flange.

20. The crankcase ventilation apparatus according to claim 19, wherein the positioning means are formed by a threaded hole provided in the connecting flange, a screw hole which is formed to fit to the structural unit and can be brought into congruence with the threaded hole, and a screw which can be screwed into the threaded hole through the screw hole.

* * * * *